United States Patent [19]

Plice et al.

[11] 4,000,381

[45] Dec. 28, 1976

[54] MOVING MAGNET TRANSDUCER

[75] Inventors: Gerald W. Plice, Morton Grove; Thomas H. Tichy, Clarendon Hills, both of Calif.

[73] Assignee: Shure Brothers Inc., Evanston, Ill.

[22] Filed: May 23, 1975

[21] Appl. No.: 580,536

[52] U.S. Cl. ..... 179/114 M

[51] Int. Cl.[2] ..... H04R 11/00

[58] Field of Search ..... 179/104, 114 R, 114 A, 179/114 M, 115 R, 115 A, 115.5 R, 115.5 E, 115.5 DV, 107 E

[56] References Cited

UNITED STATES PATENTS

| | | | |
|---|---|---|---|
| 1,713,210 | 5/1929 | Barton | 179/115 R |
| 1,869,665 | 8/1932 | Chann | 179/115.5 VC |
| 2,951,190 | 8/1960 | Baermann | 179/114 M |
| 2,552,800 | 5/1951 | Lybarger | 179/115 R |
| 3,061,689 | 10/1962 | McCarrell et al. | 179/107 E |

FOREIGN PATENTS OR APPLICATIONS

| | | | |
|---|---|---|---|
| 863,082 | 1/1953 | Germany | 179/115 |
| 833,737 | 4/1960 | United Kingdom | 179/1 ST |

*Primary Examiner*—George G. Stellar
*Attorney, Agent, or Firm*—Allegretti, Newitt, Witcoff & McAndrews

[57] ABSTRACT

A miniature acoustical transducer. The transducer includes a diaphragm, spring member and electromagnetic coils secured within a substantially cylindrical housing. The coils are arranged on opposite sides of the spring member. The spring member carries a permanent magnetic member and is connected to the diaphragm. Movement of the magnetic member relative to the electromagnetic coils varies the reluctance of the magnetic circuit defined by the coil and an associated core member.

10 Claims, 2 Drawing Figures

MOVING MAGNET TRANSDUCER

BACKGROUND OF THE INVENTION

The present invention relates generally to a transducer and more particularly to an acoustical transducer for use as an ear insert receiver.

Magnetic transducers are well known for use as ear insert receivers. The most commonly used transducer is a moving armature type, often referred to as a controlled magnetic or variable reluctance transducer.

As well known, the variable reluctance transducer must be precision adjusted to center the movable armature between the pole pieces of the magnetic circuit. Thus, the variable reluctance transducer is particularly sensitive to any force offsetting the armature, such as shook, vibration, mechanical stress on the transducer housing or extreme variations in temperature.

Other factors and structural features of the variable reluctance transducer further exaggerate this sensitivity problem. The armature is usually a soft ductile alloy with a very low yield strength. As such, the armature is easily deformed.

In many transducers, particularly receivers driven by a single-ended amplifier, a D.C. bias current is unavoidable. Such a bias current will offset the armature of the variable reluctance transducer with respect to the pole pieces and thereby adversely effect operation and efficiency.

SUMMARY OF THE INVENTION

In a principal aspect, the present invention is an acoustical transducer including a housing, diaphragm, spring member, magnetic member and electromagnetic coils. The housing, which defines a hollow, substantially cylindrical chamber, includes a sound opening at one end.

The diaphragm is secured within the housing and directly communicates with the sound opening. The spring member is secured in an intermediate portion or region of the housing and carries the magnetic member. The spring member and diaphragm are connected.

The electromagnetic coils are secured within the housing on opposite sides of the spring member. Preferably, the coils are substantially annular and coaxial with the hollow interior chamber of the housing. Each coil includes a core member having a predetermined reluctance.

Energization of the electromagnetic coils by an external A.C. voltage source causes the magnetic member to oscillate therebetween. That is, the magnetic member is attracted and repelled by the coil cores with a force proportional to the applied voltage. The frequency of oscillation corresponds substantially to the frequency of the A.C. source voltage. In response, the diaphragm vibrates to produce acoustical waves. The spring member and diaphragm cooperatively urge the magnetic member towards a relaxed position or state.

Conversely, acoustical waves impinging upon the diaphragm cause the magnetic member to oscillate in the gap between the electromagnetic coils. A voltage is, therefore induced in the coils.

It is thus an object of the present invention to provide a transducer which substantially avoids the problems experienced with the presently known transducers, including particularly the presently known ear insert receivers.

It is also an object of the present invention to provide a miniature transducer for use as an ear insert receiver.

It is a further object of the present invention to provide a miniature transducer for use as a microphone.

It is another object of the present invention to provide a miniature acoustical transducer wherein the components are substantially self-aligning to permit quick and easy assembly of the transducer.

It is another object of the present invention to provide an acoustical transducer which is substantially shock, vibration and temperature resistant.

These and other objects, features and advantages of the present invention will become apparent in the following detailed description.

BRIEF DESCRIPTION OF THE DRAWING

A preferred embodiment of the present invention will be described, in detail, with reference to the drawing wherein.

DESCRIPTION OF THE PREFERRED EMBODIMENT

Figure 1:
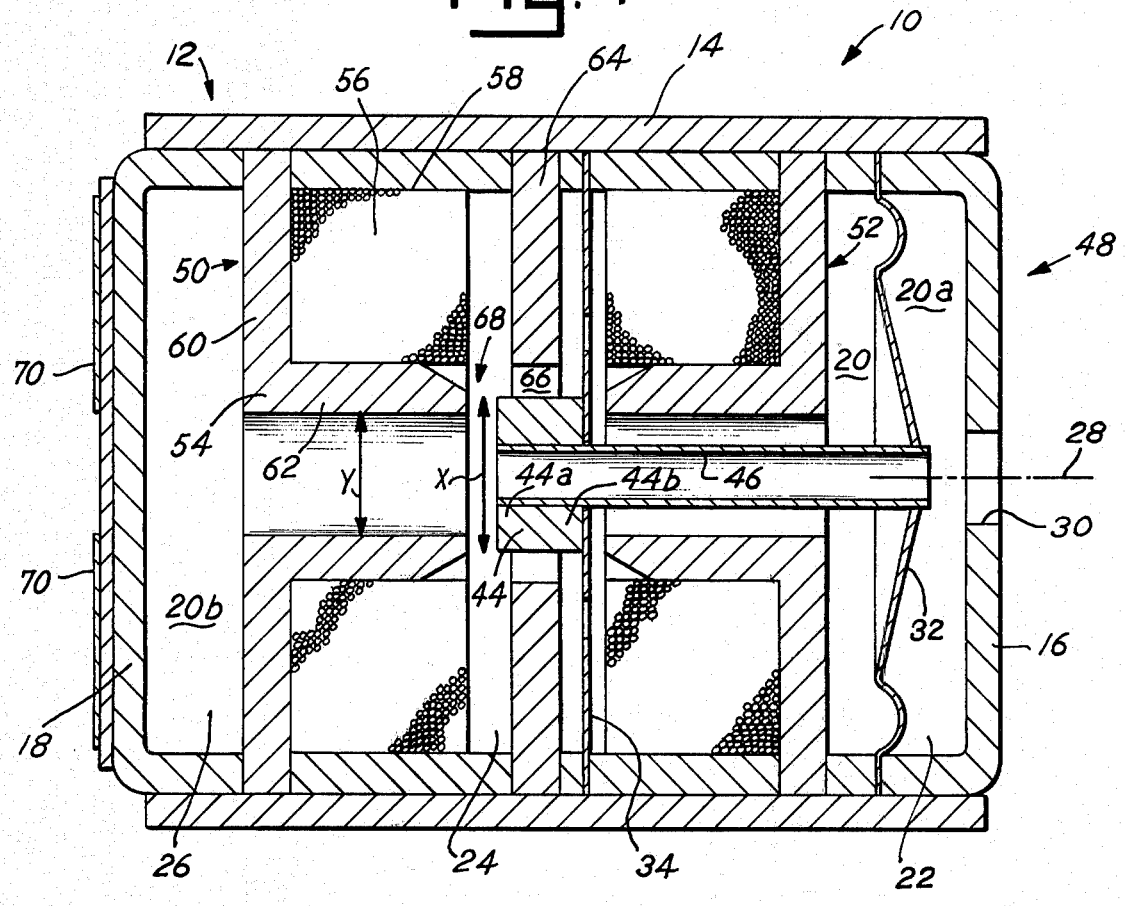
FIG. 1 is a cross-sectional view of a preferred embodiment of the present invention.

A preferred embodiment of the present invention is shown in FIG. 1 as an acoustical transducer 10. The transducer 10 includes a substantially cylindrical housing 12, defined by an annular wall member 14 and a pair of end panels 16, 18.

As such, the housing 12 defines a hollow, substantially cylindrical interior chamber 20. The chamber 20 has three portions or regions, i.e., a first end portion 22, an intermediate portion 24 and a second end portion 26. The end panel 16 closes the housing 12 at the first end portion 22 of the chamber 20. The central axis of the housing 12, annular wall member 14 and chamber 20 is shown in FIG. 1 at 28.

The end panel 16 includes a sound opening 30. Preferably, the sound opening 30 is circular and centrally located in the end panel 16, i.e., substantially coaxial with the housing 12.

A substantially circular diaphragm 32 is secured in the housing 12 in the first end region 22 of the chamber 20. The diaphragm 32 directly communicates with the sound opening 30 and acoustical waves which pass therethrough impinge upon the diaphragm 32. Conversely, acoustical waves produced and generated by movement of the diaphragm 32 exit the housing 12 through the sound outlet 30.

The diaphragm 32 is preferably a molded mylar polyester film. As shown, the diaphragm 32 is slightly thicker at the center than the edges. This cross-sectional dimensioning strengthens and stiffens the central region of the diaphragm 32 to develop substantially piston-like motion within the transducer 10. In addition, the dimensioning maximizes the effective area of the diaphragm 32.

Figure 2:
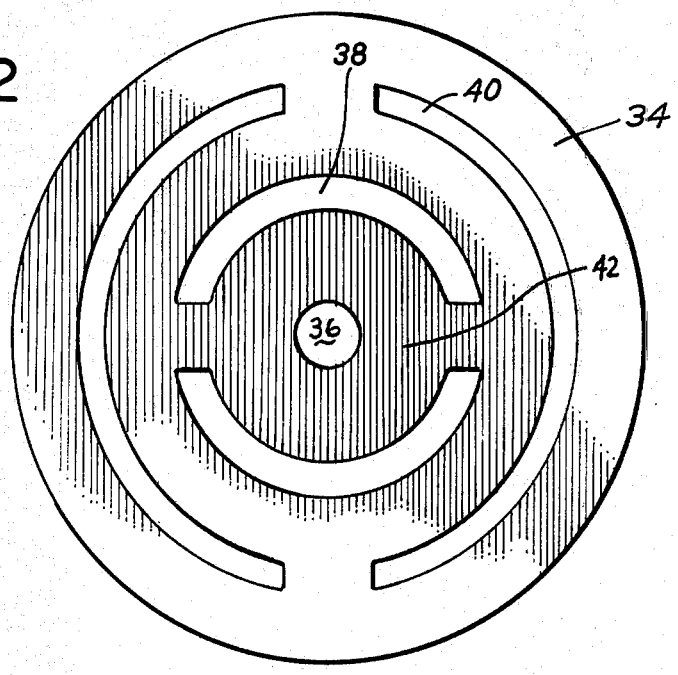
FIG. 2 is a plan view of a spring member for use in the preferred embodiment shown in FIG. 1.

A plate spring member 34 is secured in the intermediate region 24 of the housing 12 and chamber 20. Referring to FIG. 2, the spring member 34 is preferably substantially circular such that the housing 12 and spring member 34 are substantially coaxial in the assembled transducer 10.

The spring member 34 includes a substantially concentric opening 36 and a pair of opposing slots 38, 40. The slots 38, 40 are substantially semicircular and extend approximately 160°. The slots 40 are displaced radially and rotated 180° with respect to the slots 38.

The spring member 34 also includes a central region 42, intermediate the opening 36 and slots 38.

The spring member 34 is a non-ferrous spring material, preferably beryllium copper. The slots 38, 40 are etched in the spring member 34. The interposition of slots 38, 40 provides the required degree of flexibility.

As shown in FIG. 1, a substantially annular, permanent magnetic member 44 is rigidly and coaxially attached to the central region 42 of the spring member 34. The permanent magnetic member 44 is secured on the side of the spring member 34 opposite the diaphragm 32. Preferably, the magnetic member 44 is a high energy permanent magnet, such as samarium cobalt (SmCo), which is polarized to produce magnetic poles on the opposing ends 44a, 44b of the magnetic member 44.

The diaphragm 32 and spring member 34 are interconnected by a connector 46. In this preferred embodiment, and for illustrative purposes alone, the connector 46 is a hollow, lightweight aluminum tube. As shown in FIG. 1, tube 46 substantially axially aligns with the housing 12 and is secured to the inner wall of the annular magnetic member 44 through the opening 36 of the spring member 34.

The magnetic member 44 has an "at rest" or relaxed position or state with respect to the housing 12. The relaxed position is predominantly defined and determined by the spring member 34. When the magnetic member 44 is displaced, the diaphragm 32, spring member 34 and connector 46 cooperatively define means, generally designated 48, for urging the magnetic member 44 towards the relaxed state. The urging force is, however, predominantly exerted by the spring member 34.

The transducer 10 also includes a pair of electromagnetic circuits 50, 52. The circuits 50, 52 are secured within the housing 12 on opposite sides of the spring member 34. The circuits 50, 52 are structurally similar and only one will be described herein, although the disclosure is equally applicable to the other circuit.

The circuit 50 includes a substantially annular core member or pole piece 54 and associated coil 56. Preferably, the core member 54 is a nickeliron alloy material of high permeability. The core member 54, in cross-section, defines a substantially rectangular cavity region 58. The coil 56 is wound in the cavity region 58.

More particularly, the core member 54, in cross-section, includes a C or U-shaped pole piece 60 having an innermost wall portion 62. The inner diameter of the annular core member 54 is designated Y in FIG. 1.

The core member 54 also includes a substantially annular, center pole piece 64 having a central opening 66. The circuits 50, 52 cooperatively share the center pole piece 64, as shown in FIG. 1.

The core member 54 has an air gap, generally designated 68, between the innermost wall portion 62 of the C or U-shaped pole piece 60 and the center pole piece 64. The wall portion 62 is tapered at the air gap 68 to concentrate the magnetic flux, produced by excitation of the coil 56, in the innermost portion of the air gap 68, i.e., the portion closest to the magnetic member 44.

In the relaxed state, shown in FIG. 1, the magnetic member 44 is within the opening 66, substantially aligned with the center pole piece 64 and substantially equidistant from the magnetic circuits 50, 52. The outer diameter X of the annular magnetic member 44 is greater than the inside diameter Y of the core member 54, such that the magnetic member 44 extends directly into the air gaps 68. Movement of the magnetic member 44 towards the wall portion 62 of either core member 54 reduces the air gap 68 and reluctance of the corresponding magnetic circuit 50, 52.

The coils 56 are excited by application of a voltage to terminals 70 on the exterior surface of the end panel 18. The coil polarity of the magnetic circuits 50, 52 causes the magnetic member 44 to oscillate substantially along the axis 28 in response to an A.C. voltage signal. Thus, a "push-pull" force is exerted on the magnetic member 44 by the magnetic circuits 50, 52.

The force exerted on the magnetic member 44 by the diaphragm 32 and spring member 34 substantially exceeds the induced attractive force between the magnetic member 44 and magnetic circuits 50, 52. Thus, contact of the magnetic member 44 and core members 54 is substantially avoided under normal operating conditions. Contact would, of course, cause distortion.

The transducer 10 is approximately 7.35 millimeters in length and 5.80 millimeters in diameter. The weight of the transducer 10 is approximately 1.15 grams.

Several advantages are derived from the present invention and preferred embodiment herein disclosed. Having a small diameter, cylindrical shape and a sound opening at one end ("end-fired"), the transducer 10 is particularly suitable as an ear insert receiver. Contrastingly, the variable reluctance transducer is preferably rectangular in shape.

The cylindrical construction also substantially reduces production times and manufacturing costs. As best shown in FIG. 1, the components of the transducer 10 are substantially concentric with the housing 12. The components are, therefore, self-aligning. Further, circular components are more readily and inexpensively fabricated to close dimensional tolerances.

As indicated, the transducer 10 additionally functions as a miniature microphone. In this mode, the tube 46 serves as a "Thuras" tube, i.e., an acoustical inertance in resonant relationship with the front and rear cavities 20*a*, 20*b*, respectively of the transducer 10, as defined by the housing 12 and diaphragm 32. As such, the tube 46 boosts the low frequency response of the transducer 10.

Due to the large working air gap and magnetic circuitry geometry, the transducer 10 is, in contrast with the variable reluctance transducer previously discussed, substantially less sensitive to an "off-center" condition, i.e., offset of the magnetic member 44 with respect to the pole pieces. Further, the high yield strength spring member 34 is particularly less vulnerable to deformation under stress. Thus, the transducer 10 is substantially more resistant to shock, vibration and temperature change and substantially less sensitive to D.C. bias currents than the presently known variable reluctance transducer.

The precision centering requirement of the variable reluctance transducer causes an additional problem and/or shortcoming. With large drive currents, the displacement of the movable armature becomes nonlinear resulting in high harmonic distortion. By substantially avoiding the "centering" problem, the transducer 10 responds relatively linearly over a larger range and thereby substantially avoids high harmonic distortion.

The impedance of the variable reluctance transducer is also highly reactive and frequency-dependent. The response of the variable reluctance transducer therefore varies with the output impedance of the driving amplifier. The impedance of the transducer 10, on the other hand, is substantially resistive and therefore relatively frequency-independent.

A single preferred embodiment of the present invention has been herein described. It is to be understood, however, that various modifications and changes could be made without departing from the true scope and spirit of the present invention as set forth and defined by the following claims.

What is claimed is:

1. An acoustical transducer comprising, in combination:

a housing having a first end portion, an intermediate portion and a second end portion, said housing defining a substantially cylindrical interior chamber having a central axis, said housing including an end panel closing said first end portion, said end panel having a sound opening for passage of acoustical waves therethrough;

a diaphragm secured substantially within said first end portion, substantially adjacent said end panel and in direct communication with sound opening, said diaphragm defining a front and rear cavity in said interior chamber;

a spring member secured substantially within said intermediate portion of said housing, said spring member having a central region substantially aligned with said central axis;

a hollow lightweight tube connecting said spring member and said diaphragm, said tube linking said front cavity and said rear cavity to substantially improve the frequency response of said transducer;

a magnet member secured to said spring member substantially within said central region; and a pair of substantially annular electromagnetic circuits secured within said housing on opposite sides of said spring member, said electromagnetic circuits being substantially coaxial with said chamber, said electromagnetic circuit including a coil and a core member having a predetermined reluctance, movement of said magnetic member toward said core member reducing said predetermined reluctance;

said magnetic member having a relaxed state relative to said pair of electromagnetic coils;

said spring member, connector means and diaphargm cooperatively defining bias means for urging said magnetic member towards said relaxed position.

2. An acoustical transducer as claimed in claim 1 wherein said spring member is a substantially circular plate spring.

3. An acoustical transducer as claimed in claim 2 wherein said substantially circular plate spring member is slotted about said central region to provide flexibility.

4. An acoustical transducer as claimed in claim 1 wherein said core member defines an air gap.

5. An acoustical transducer as claimed in claim 4 wherein said magnetic member moves substantially within said air gap in response to energization of said coil and acoustical wave impinging upon said diaphragm.

6. An acoustical transducer as claimed in claim 5 wherein movement of said magnetic member towards said core member reduces said air gap and thereby reduces said predetermined reluctance of said core member.

7. An acoustical transducer as claimed in claim 1 wherein said magnetic member is a permanent magnet.

8. An acoustical transducer as claimed in claim 7 wherein said magnetic member is samarium cobalt (SmCo).

9. An acoustical transducer as claimed in claim 1 wherein said magnetic member is substantially annular and defines an inner wall.

10. An acoustical transducer as claimed in claim 9 wherein said tube securingly engages said inner wall of said magnetic member.

* * * * *